US011760441B2

(12) United States Patent
Lisiecki et al.

(10) Patent No.: US 11,760,441 B2
(45) **Date of Patent: *Sep. 19, 2023**

(54) PONTOON COVER SYSTEM

(71) Applicant: B&W Holding, LLC, Punta Gorda, FL (US)

(72) Inventors: William A. Lisiecki, Duluth, MN (US); Wayne R. Smith, Punta Gorda, FL (US)

(73) Assignee: B&W Holding, LLC, Punta Gorda, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/661,371

(22) Filed: Apr. 29, 2022

(65) Prior Publication Data

US 2022/0363344 A1 Nov. 17, 2022

Related U.S. Application Data

(63) Continuation of application No. 16/992,839, filed on Aug. 13, 2020, now Pat. No. 11,345,445.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | |
|---|---|---|---|
| 4,641,600 | A | 2/1987 | Halvorsen |
| 6,439,150 | B1 | 8/2002 | Murphy et al. |
| 6,978,732 | B1 | 12/2005 | Jirak |
| 8,056,495 | B2 | 11/2011 | Lemons |
| 11,345,445 | B2 | 5/2022 | Lisiecki et al. |
| 2022/0048597 | A1 | 2/2022 | Lisiecki et al. |

OTHER PUBLICATIONS

U.S. Appl. No. 16/992,839 U.S. Pat. No. 11,345,445, filed Aug. 13, 2020, Pontoon Cover System.
"U.S. Appl. No. 16/992,839, Non Final Office Action dated Jan. 19, 2022", 5 pgs.
"U.S. Appl. No. 16/992,839, Non Final Office Action dated Oct. 29, 2021", 7 pgs.

(Continued)

*Primary Examiner* — Lars A Olson
(74) *Attorney, Agent, or Firm* — Schwegman Lundberg & Woessner, P.A.

(57) ABSTRACT

Systems and techniques for a pontoon covering system are described herein. In an example, a pontoon cover on a spindle is mounted to the rear of the pontoon using a one or more mounting brackets, the mounting bracket including a first portion configured to translate longitudinally with respect to second portion. The cover can be positioned over a support structure connected to the pontoon. The support structure may al low the cover, including a cover securing member support to be aligned with a cover securing member attached to the side of the pontoon. The cover may be secured in the front by a front securing member, and pulled taut over the support structure by turning a handle connected to the spindle while the cover securing member is secured or engaged at least partially within the cover securing member support.

18 Claims, 11 Drawing Sheets

(56) References Cited

OTHER PUBLICATIONS

"U.S. Appl. No. 16/992,839, Notice of Allowance dated Apr. 5, 2022", 8 pgs.
"U.S. Appl. No. 16/992,839, PTO Response to Rule 312 Communication dated May 2, 2022", 2 pgs.
"U.S. Appl. No. 16/992,839, Response filed Jan. 3, 2022 to Non Final Office Action dated Oct. 29, 2021", 11 pgs.
"U.S. Appl. No. 16/992,839, Response filed Mar. 16, 2022 to Non Final Office Action dated Jan. 19, 2022", 8 pgs.
"Boat Covers—National Boat Covers", [Online], Retrieved from the Internet: <URL: https://www.nationalboatcovers.com/>, (Accessed Mar. 23, 2021), 5 pgs.
"Easy Cover—Devil's Lake Water Sports", [Online], Retrieved from the Internet: <URL: https://dlwatersports.com/easy-cover/>, (Accessed Mar. 23, 2021), 6 pgs.
"Reel EZ Boat Cover—World's Easiest and Quickest Boat Cover", [Online], Retrieved from the Internet: <URL: http://www.reelezboatcover.com/>, (Accessed Mar. 23, 2021), 4 pgs.
"The Boat Guard—Boat Covers", [Online], Retrieved from the Internet: <URL: https://www.theboatguard.com/>, (Accessed Mar. 23, 2021), 4 pgs.

PONTOON COVER SYSTEM

CROSS-REFERENCE TO RELATED APPLICATION

This application is a continuation of U.S. patent application Ser. No. 16/992,839, filed Aug. 13, 2020, which is incorporated by reference herein in its entirety.

TECHNICAL FIELD

The present disclosure relates to coverings for boats, specifically to a pontoon cover system.

BACKGROUND

Boats are used in a variety of environments which can often have a wide range of temperature swings, or seasonal changes (e.g., wet and dry cycles, hot and humid summers that transition to freezing temperatures in winter, or the like), and can also be subjected to "every day" elements such as ultraviolet rays, wind, rain, hail, dirt/dust, bird droppings, or the like. The deck of a boat, such as a pontoon, often have elements or fixtures such as fabric-covered seats or benches, electronic controls, or the like, that can be damaged if left exposed to the environmental elements listed above, and a cover that does not fit properly may not sufficiently keep such environmental elements out, or prevent proper air flow which can cause damage such as mold growth or the like on the deck of the pontoon when it is stored.

SUMMARY

Described herein are systems and methods for a pontoon covering system A system may generally include a cover, made from a material such as canvas or another similar material which can be stored (e.g., spooled, wrapped, wound around, or the like) on a spindle, having a first end and a second end, the first end including a first locking pin, and the second end including a second locking pin. The spindle may be connected to the pontoon using a first and second spindle mounting bracket. In an example, the first spindle mounting bracket may be connected to a first rear portion of the pontoon. Such as at a left rear portion, attached to a portion of a rail of the frame of the pontoon. Similarly, the second spindle mounting bracket may be connected to a second rear portion of the pontoon, such as, for example, a right rear portion of the pontoon, attached to a portion of a rail of the frame of the pontoon. The first and second mounting brackets may be connected to the pontoon substantially opposite to each other (e.g., across from each other) on the sides of the pontoon near the rear/stern/back of the pontoon.

In an example, the first spindle mounting bracket and the second spindle mounting bracket may each have a first portion/an inner portion and a second portion/an outer portion, where the inner portion of the first spindle mounting bracket may be configured to translate, slide, shift, or the like longitudinally with respect to the outer portion of the first spindle mounting bracket. Likewise, the inner portion of the second spindle mounting bracket may be configured to translate, shift, slide or the like, longitudinally with respect to the outer portion of the second spindle mounting bracket.

In an example, the outer portion of the first and second spindle mounting bracket may be attached to the pontoon as described above such as through bolts, screws, welding, or the like, and the distance between the spindle and the rear of the pontoon may be changed by translating, sliding, shifting, or the like, the inner portions of the first and second spindle mounting brackets with respect to the inner portions of the first and second mounting brackets. Further, the inner portions of the first and second spindle mounting brackets may be held in place with respect to the first and second outer portions of the spindle mounting brackets by a pin inserted into a series of holes, or other similar openings in the inner portion and outer portion of the spindle mounting brackets which may be aligned allowing a user to choose a distance of the spindle to the rear of the pontoon. Alternatively, the inner portions of the first and second spindle mounting brackets may be held in place with respect to the first and second outer portions of the spindle mounting brackets by another similar temporary locking mechanism.

The spindle may attach to the first and second spindle mounting brackets by inserting the first and second spindle mounting pins, on the first and second ends of the spindle, into the first and second inner portions of the first and second mounting brackets. This may be accomplished using, for example, a groove, slot, opening, or the like in the inner portions of the first and second mounting brackets. The first spindle mounting bracket may include a first spindle locking member, and the second spindle mounting bracket may include a second spindle locking member. The spindle locking members may be attached to the inner portion of the first and second spindle mounting brackets, and may be configured to turn, twist, slide, translate, or the like to secure the spindle by covering the groove, slot, opening, or the like in the inner portion of the first and second spindle mounting brackets after the spindle mounting pins are inserted into the grooves, slots, openings, or the like.

In an example, only one end of the spindle may need to be secured or locked by a locking member. For example, one of the first or second mounting bracket may have a hole or other similar opening on the inner portion, into which one of the first or second spindle mounting pins may be inserted, placed, or the like. In such an example, the other the spindle mounting bracket may have a groove, slot, opening, or the like as described above, into which the other of the first or second spindle mounting pins may be inserted, located, placed, or the like, and locked in place with a locking member as described above.

The system may also include a ratchet wheel connected to at least one end of the spindle, a pall connected to at least one of the first or second mounting brackets, and a handle connected to the spindle, configured to rotate the spindle and the ratchet wheel when winding or tightening the cover.

In an example, the system may also include a securing member/cover side securing member connected to a side of the pontoon. Such as, connected to one or more frame rails of the pontoon along at least one of the right or left sides of the pontoon. The securing member may be configured to secure the cover to the side of the pontoon. In an example, the cover securing member may be a linear actuator contained within a housing connected to the side of the pontoon. The linear actuator may include a piston configured to extend from or retract into the linear actuator. In an example, the linear actuator may be wired to at least one of a switch, button, or other actuation member, and a power source such as a battery. The linear actuator piston may be configured to extend from or retract into the linear actuator by engaging the button, switch, or the like.

The system may also contain a securing hook connected to an end of the linear actuator piston, such that the securing hook, is at least partially secured, contained, inserted, or the like, into a securing member support, for example, a pocket sewn into the cover. In an example, the pocket may be of the same or a different material than the material of the cover.

In another example, the securing member may be a cover securing pin connected to a side of the pontoon. Such as attached to a portion of the existing frame of the pontoon. In another example, the pin may be attached to a separate rail, rod, or other support attached to the side of the pontoon. In an example, the cover securing pin may be configured to be at least partially secured in a securing member support, which may be a pocket or loop attached to the cover. The pocket or loop may be, for example, a fabric with an elasticity. In another example, the pocket or loop may be the same material as the cover.

The system may also include a support structure configured to mount to the pontoon, such as to span across the width of the pontoon, near a mid-section of the pontoon (e.g., the middle of the pontoon). In an example, the support structure may mount directly to the existing frame of the pontoon. In another example, the support structure may be mounted to the frame of the pontoon using a bracket or other attachment member.

The system may be deployed by at least partially removing the cover from the spindle, such as by unwinding, unspooling, or the like, and placing, draping, stretching, or the like, the cover over the support structure so the securing member support is aligned so as to be proximate, next to, near, or the like, the securing member. In an example, a weight may be affixed, located, or attached to the cover (such as sewn into a pocket in the cover) to help place the securing member support near the securing member when the cover is placed over the support structure.

In an example, at least a portion of the securing member may be secured within the securing member support. The cover may be tightened, contracted, cinched, pulled tight, pulled taut, or the like, by rotating the handle connected to the spindle. The rotation of the spindle may be controlled by a tooth of the ratchet wheel being caught on the pall when the ratchet wheel is caused to rotate by the handle. The securing member may be caused to be located in a final position within the securing member support by the tightening of the cover by rotation of the spindle.

In an example, the system may include a second securing member configured to secure a portion of a front portion of the cover to the front portion of the pontoon (e.g., the bow). For example, a portion of the front portion of the cover may have a securing member such as a magnet, the socket or the stud of a snap, or other similar securing members. In an example, a portion of the front of the pontoon may have a securing member such as a second magnet or the other of the socket or stud of a snap to that attached to the cover, or the like. Then, the member on the cover and the member on the pontoon may be connected so as to attach the front of the cover to the front of the pontoon. For example, by connecting the socket and stud of the snaps together to secure the cover in place on the front of the pontoon. The cover may be removed by releasing a tension of the spindle, disconnecting, disengaging, detaching, or the like, the second cover securing member (e.g., to disconnect the front portion of the cover from the front portion of the pontoon), releasing the securing member, and returning the cover to its undeployed state wound/spooled around the spindle.

It is understood that the system may include a plurality of securing members and securing member supports along one or both of the sides of the pontoon, and a plurality of second securing members to secure the front of the cover to the front of the pontoon. Further, it is understood that different combinations of securing members, securing member supports, and second securing members described herein may be used as a part of the system.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

In many areas, boats, such as pontoons, are required to be stored for a period of time when not in use. This may include storing a pontoon so as to secure it for several months, such as during the winter, or simply to store it when not currently in use. In each case, a cover system may help keep the pontoon clean or reduce damage due to inclement weather conditions. Existing cover systems may be unwieldy and time consuming to deploy or attach to a pontoon, and may not include an efficient way to store the cover. This may result in the cover being lost or damaged without an effective way to store or keep the cover when it is not being used.

Figure 1:
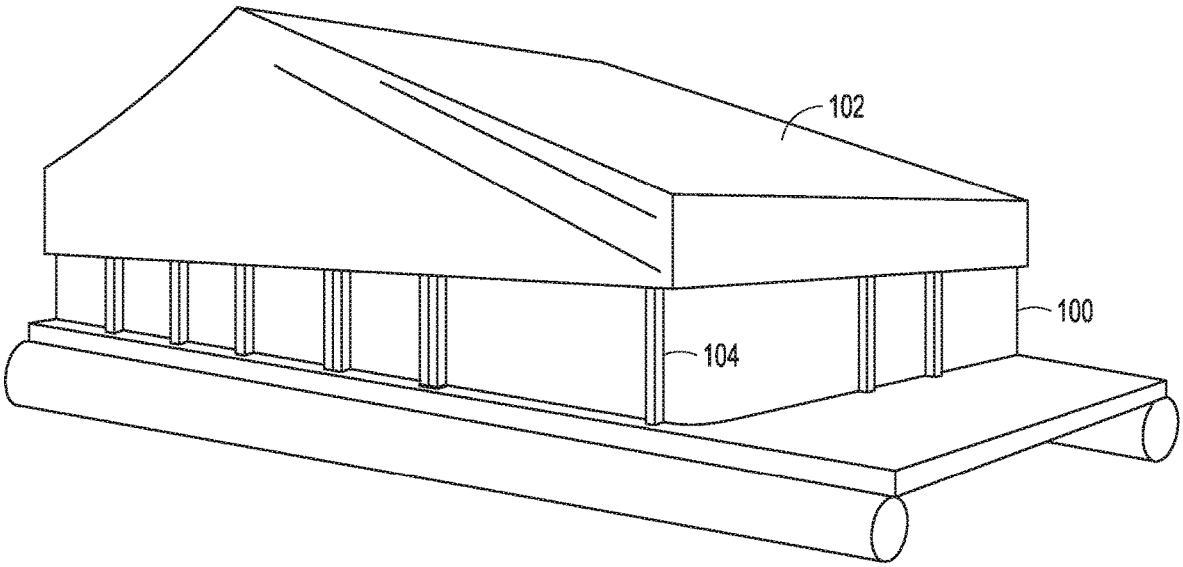
FIG. 1 illustrates an example of a deployed pontoon cover system.

Described herein are systems and methods for a pontoon or other boat covering system. FIG. 1 illustrates an example of a deployed pontoon cover system. The system may consist of a cover 102, which can be deployed across the span (e.g., across the top from a bow portion to a stern portion) and around the sides of a pontoon 100. In an example, the cover can be secured to a pontoon frame rail 104, which may be existing on the pontoon 100 from the time the pontoon 100 is manufactured, built, assembled, or the like before the pontoon 100 is sold, or added to the pontoon 100 after it is sold to a user. The pontoon 100 may include a plurality of frame rails 104, which may surround, enclose, or the like, a portion of the pontoon 100. The cover 102, may be made of a material (e.g., canvas or the like) which can be secured to the pontoon 100 at multiple locations, including along the sides, the front, the rear, or one or more combination of those, to protect the interior (e.g., the deck) of the pontoon from damage from elements such as ultraviolet rays, snow, rain, hail or the like, or from things that may not necessarily cause damage or affect the operation of the pontoon, but would otherwise require the pontoon to be cleaned (such as leaves, bird droppings, or the like).

Figure 2:
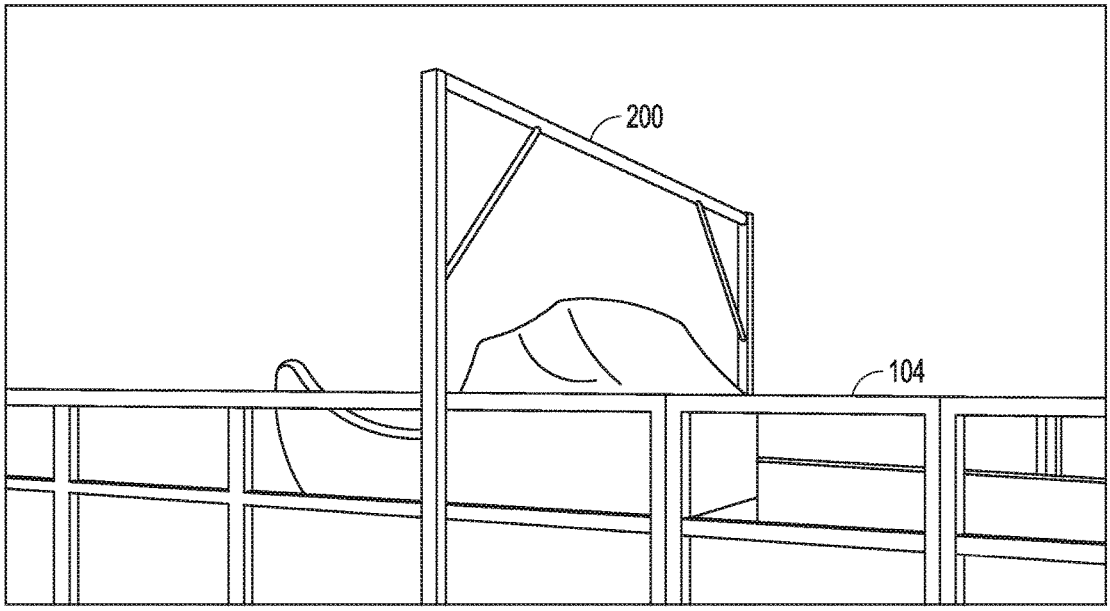
FIG. 2 illustrates an example of a support structure over which a cover may be deployed.

FIG. 2 illustrates an example of a support structure over which a cover may be deployed. In an example, a support structure 200 may be attached to the pontoon 100, such as by attaching the support structure 200 to a portion of the frame of the pontoon 100, such as at one or more locations of the pontoon frame rail 104. In an example, the support structure 200 may be permanently attached to the pontoon 100, such as being welded to the frame of the pontoon 100, at locations along the frame rail 104.

In another example, the support structure 200 may mount into an existing opening (e.g., a hole, slot, gap, or the like) on an upper surface of the pontoon frame rail 104, along each side of the pontoon 100. In another example, the support structure 200 may be attached to a portion of the pontoon frame rail 104 through the use of a bracket, or other securing/mounting member attached to the pontoon 100 or the frame rail 104. In an example, the support structure 200 may be configured to extend to a height above the frame of the pontoon 100. For example, the support structure 200 may be configured to extend to a height above the frame of the pontoon 100 of about 32 inches above the upper surface of the pontoon frame rail 104. Although, the height that the support structure 200 extends above the frame or frame rail 104 of the pontoon 100 is not so limited and may be within any suitable range of heights, such as between about 25 and 40 inches, inclusive. In an example, the height of the support structure 200 above the frame or frame rail 104 may be adjustable by a user (e.g., pontoon owner) within any suitable range of heights, such as between about 25 and 40 inches, inclusive. In another example, the support structure 200 may be configured to, or adjustable so as to, extend to a height above the frame or frame rail 104 of the pontoon 100 so that a pitch of a cover extending from the front of the pontoon 100 to the support structure 200 is between about 10 degrees and 25 degrees, inclusive, and/or a pitch of a cover extending from the back of the pontoon 100 to the support structure 200 is between about 10 degrees and 25 degrees, inclusive.

In an example, the support structure 200 may be removable, when the cover 102 is not deployed over the pontoon 100. The support structure 200 may be mounted, affixed, attached, or the like (either permanently or removably as described above) to the pontoon 100 at a portion that is approximately in the middle of the pontoon 100 (e.g., halfway between the bow/front and the stern/rear).

In an example, the support structure 200 may be made of a material such as aluminum, or a similar metal or rigid material. The support structure 200 may be a single, solid component, piece, or the like, or may be assembled either before or during attachment to the pontoon. For example, the support structure 200 may include two "L shaped" members that attach to the frame of the pontoon 100, as described above, and connect to each other at a middle, top portion, to form a downward facing "U shaped" structure when assembled. In another example, the support structure 200 may include three or more pieces that may be assembled to form the entirety of the support structure 200, such as pieces that slide, snap, screw or the like, together to form the support structure 200.

It is understood that the system may include multiple support structures such as support structure 200 as described above, placed at different locations of the pontoon 100. In an example, the support structure may be different from the structure 200 described above, for example, one or more poles positionable generally along a central axis of the pontoon 100, such as inserted or screwed into holes or other similar openings in the deck of the pontoon 100. It is understood that one or more of any kind of central or interior support mechanism to hold a pontoon cover such as 104 over fixtures in the interior of the pontoon 100, existing or to be developed, may be used in the system.

Figure 3:
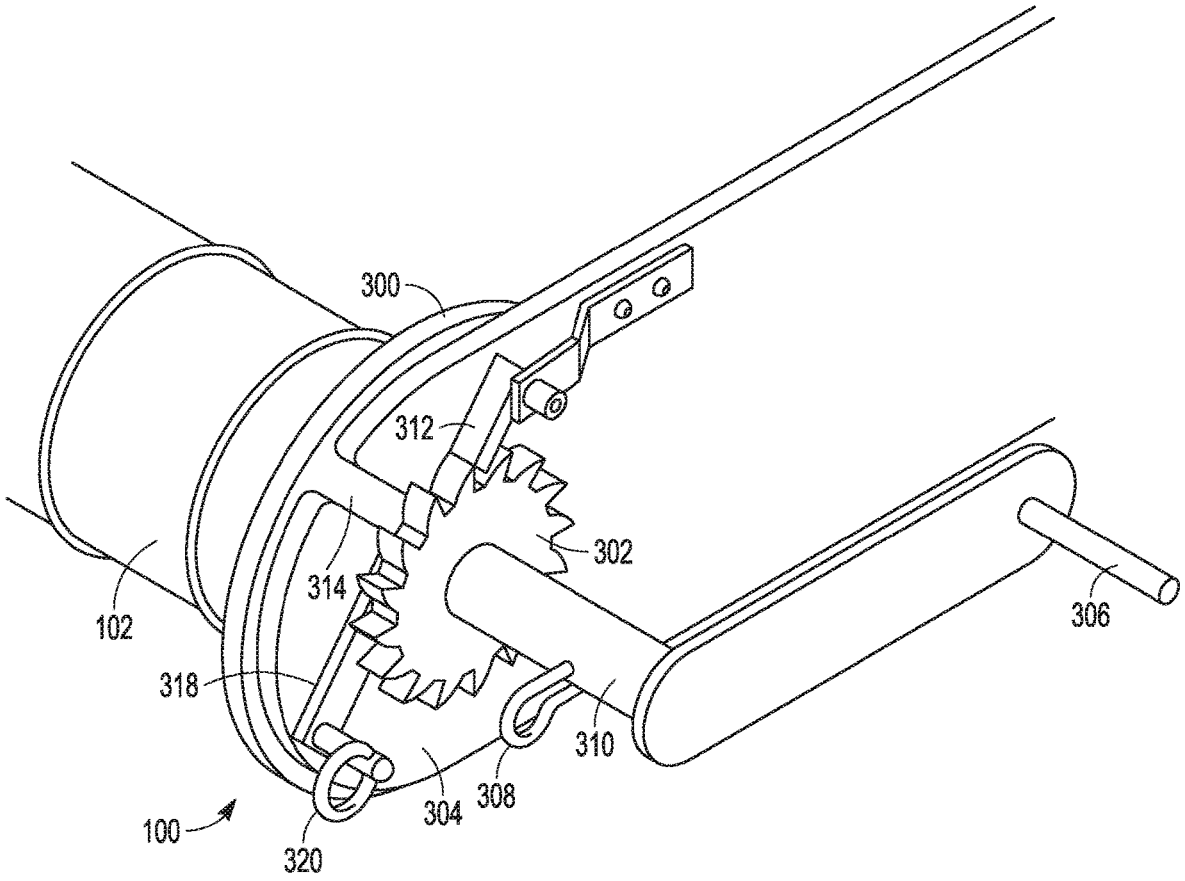
FIG. 3 illustrates an example of a spindle mount to store and deploy the cover.

FIG. 3 illustrates an example of a spindle mount to store and deploy the cover. As a part of the system, the cover 102 may be stored on a spindle (such as shown in FIGS. 4A-4F), which may be substantially cylindrical in shape, such as by spooling, wrapping-around, draping, rolling-up, or the like, the cover 102 around a spindle. A washer 300 may be located between a spindle head (such as the heads of the spindles 400A-400F shown below) and the head of a mounting bracket 304. The washer 300 may be formed from a rigid material (e.g., plastic) and have a diameter (e.g., six inches) sufficient to provide a separation between the cover 102, and a head of the mounting bracket 304. The mounting bracket 304 may attach to the rear of the pontoon 100, such as on one or more of the pontoon frame rails 104. The mounting bracket 304 may attach to the frame rail 104 through a bolt, welding, or a similar method of attachment. Another similar mounting bracket to mounting bracket 304 may be attached on the opposite rear side of the pontoon 100. In an example, the mounting brackets may be the same as described above or as described below. The spindle may be attached to the mounting bracket such as by placing a spindle mounting pin, such as 404A and 404B shown below, or another similar end portion of the spindle, into a groove 314 in the head of the spindle mounting bracket 304. The washer 300 may also prevent the cover 102 from becoming stuck, entangled, or the like, in the groove 314, as the spindle is turned.

The system may also include a spindle rotating rod 310, which may be removably attached to a spindle rotating handle 306, such as through a pin 308. The spindle rotating rod 310 may be located relative to the spindle such as to cause the spindle to rotate when the handle 306 is turned (e.g., through the center of the spindle running from a first end to a second end of the spindle). The system may also include a ratchet wheel 302 configured to mount, attach, connect, or the like, to at least one of the spindle head 300 or the spindle rotating rod 310, and to rotate when the handle 306 is turned, rotated, or the like. The spindle may be held in place by a locking member 318 located between the head of the mounting bracket 304 and the ratchet wheel 302, or other suitable location, and may be secured by a locking member pin 320. The system may also include a pall 312, attached, connected, mounted, secured, or the like, to the bracket 304. The ratchet wheel 302 and pall 312 may be configured to control, limit, inhibit, constrain, or the like, the amount of rotation (e.g., the number of degrees of rotation) the spindle is allowed to move through when deploying or securing/tightening the cover 102. In an example, the ratchet wheel 302 and/or pall 312 may be removed to allow the spindle to more freely rotate. In an alternate example, the spindle rotating handle 306 and/or any other suitable corresponding components (e.g., the ratchet wheel 302 and pall 312) may be replaced with an automatic (e.g., electrically actuated such as by an electric motor) control system that allows for automatic winding (e.g., tightening/tensioning) of the cover 102. Such automatic control system may include a battery or other suitable power source, a motor powered by the power source, and an actuator or actuators (e.g., switch (es)) for controlling the motor to wind or unwind the spindle.

In an example, the electric motor may additionally or alternately be connected, directly or indirectly, to a power source of the pontoon 100, such as a motor or battery of the pontoon 100. In an example, the electrically actuated control system may be controlled remotely via a wired or wireless remote control unit. A wireless remote control unit can be any suitable device, including a mobile communication device (e.g., a mobile phone) with software or an application (e.g., an app) stored thereon and configured to communicate with one or more other components of the automatic control system, such as a corresponding motor control unit operably connected with the motor for controlling operation thereof. A wireless remote control unit may use any suitable wireless protocol for communicating with the one or more other components of the automatic control system (e.g., the motor control unit), such as but not limited to, Bluetooth, Wi-Fi, radio-frequency (RF), near field communication (NFC), or other similar wireless protocols.

Figure 4A:
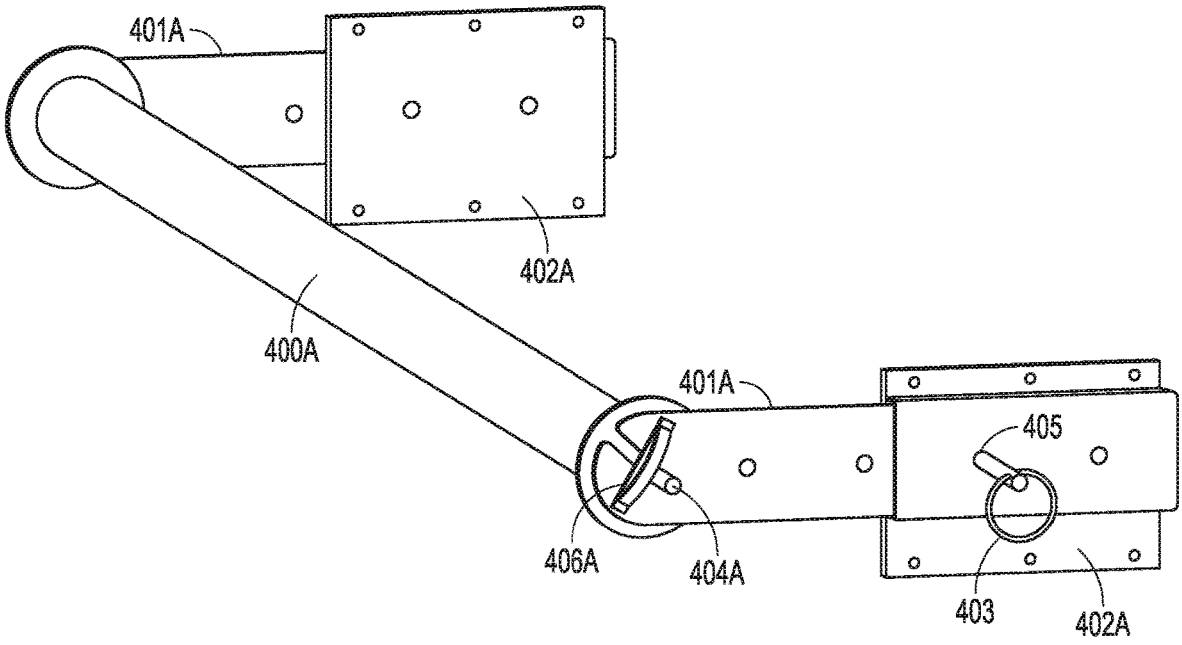
FIGS. 4A-4F illustrate examples of spindle mount designs and operation.
Figure 4B:
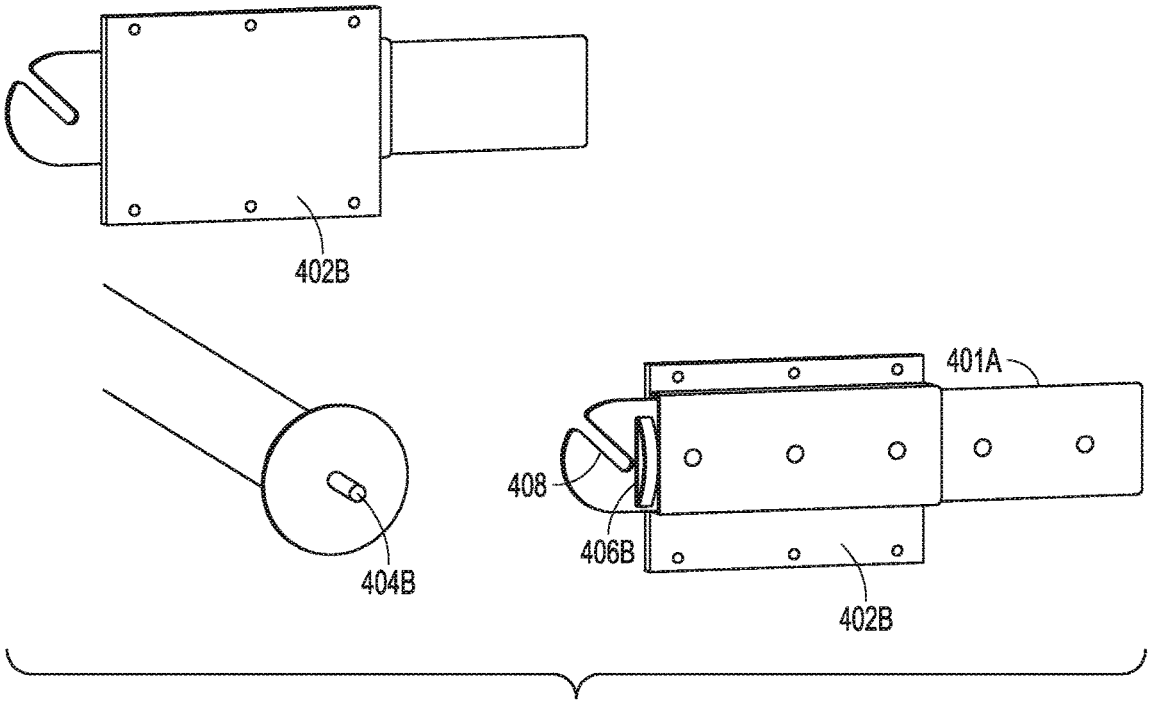

FIGS. 4A-4F illustrate examples of additional spindle mount designs and operation. As shown in FIGS. 4A and 4B, spindle 400A, 400B may be configured to attach to a spindle mounting bracket, including an inner portion 401A, 401B, and an outer portion 402A, 402B. The spindle 400A, 400B may include a locking pin 404A, 404B, which may also act as spindle rotating rod 310 (described above) and which is configured to fit into a groove 408 on a head of the inner portion of the spindle mounting bracket 401A, 401B as shown in FIG. 4B. The locking pin 404A, 404B may be secured in place by a locking member 406A, 406B which may be attached to the head of the bracket 402A, 402B, and configured to secure the locking pin 404A, 404B in the groove 408 by turning, rotating, sliding, or the like, the locking member 406A, 406B from an open position (as shown by the position in FIG. 4B) to a closed position (as shown by the position in FIG. 4A).

In an example, the spindle mounting bracket 404A, 404B may be configured so that an inner portion of the bracket 401A, 401B can slide, translate, or otherwise move with respect to the outer portion of the mounting bracket 402A, 402B, for example, longitudinally, to extend the spindle 400A, 400B when the cover 102 is being deployed, and retract the spindle 400A, 400B when in a stored position (as shown in FIG. 4B). In the stored position, a distal end of the inner portion of the mounting bracket 401A, 401B may be flush with the rear of the pontoon 100, substantially flush with the rear of the pontoon 100 or otherwise retracted proximally from a fully, distally extended position relative the rear of the pontoon 100, to eliminate or reduce the amount the inner portion of the mounting bracket 401A, 401B (and spindle 400A, 400*b*, if attached) protrudes from the back/rear of the pontoon 100. In an example, the inner portion of the mounting bracket 401A, 401B may be fixed, secured, locked, or the like, in place with respect to the outer portion of the mounting bracket 402A, 402B using a mounting bracket pin 403 which can be inserted into a hole 405 on at least one of the inner portion of the mounting bracket 401A, 401B, or the outer portion of the mounting bracket 402A, 402B, to allow for variation in the length that the inner portion of the mounting bracket 401A, 401B may protrude, extend, or the like, from the outer portion of the mounting bracket 402A, 402B, or the rear/back of the pontoon 100. In an example, the inner portion of the mounting bracket 401A, 401B, and the outer portion of the mounting bracket 402A, 402B may be mounted on each side of the rear of the pontoon 100 as described above, and the spindle locking pin 404A, 404B, the groove 408, and the spindle locking member 406A, 406B may be located on each end of the spindle 400A, 400B, to secure the spindle 400A, 400B, on each side of the pontoon 100. It is understood that "inner" and "outer" are merely terms of reference and need not indicate that one bracket portion must be internal compared with the other bracket portion. Simply, in one example, a first bracket portion (such as inner portion 401A, 401B) is translatable, slidable, or repositionable, relative to a second bracket portion (such as outer portion 402A, 402B).

Figure 4C:
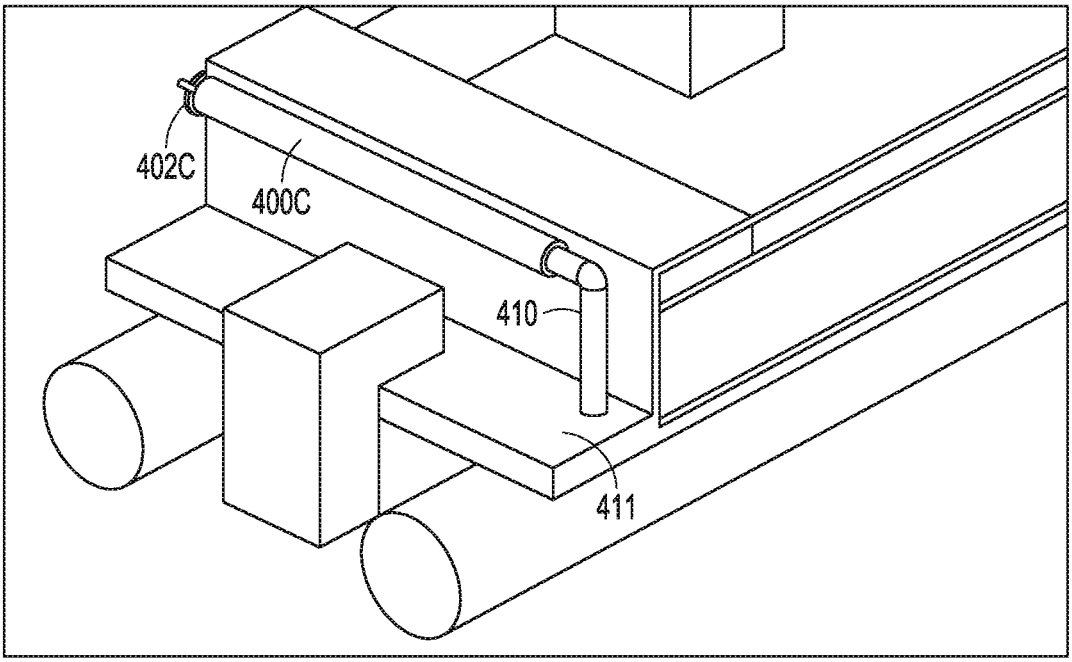
Figure 4D:
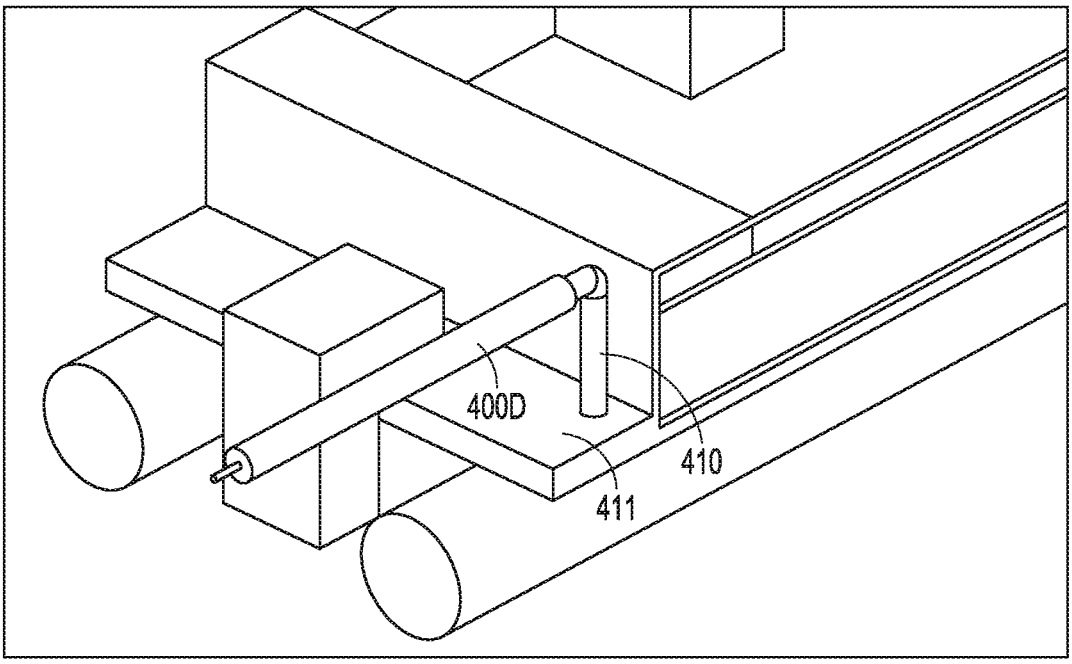
Figure 4E:
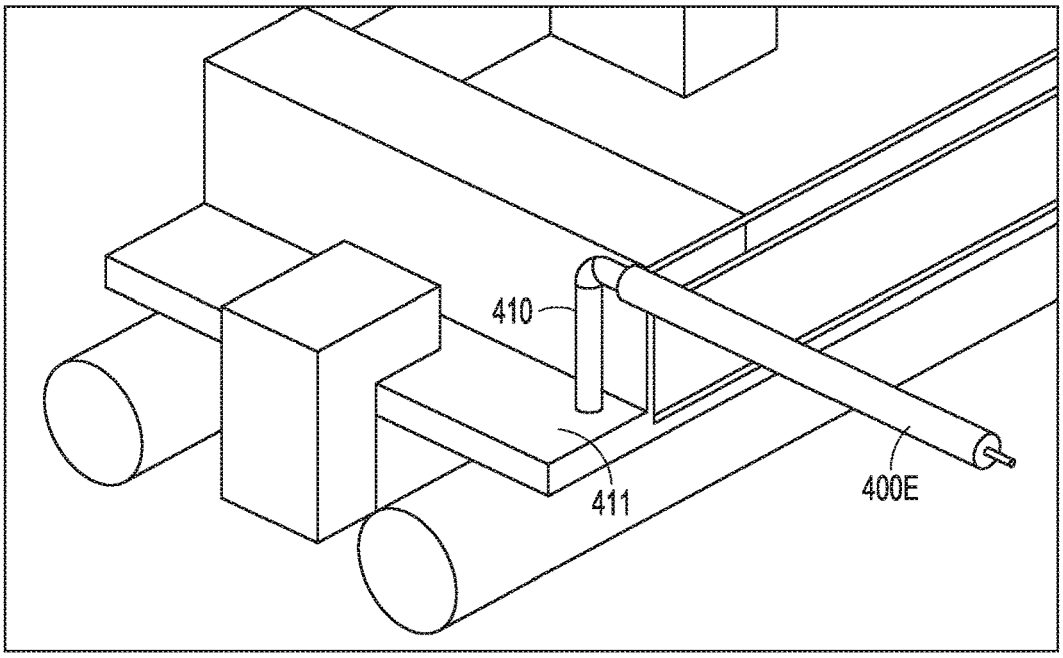

In the example shown in FIGS. 4C, 4D, and 4E, the spindle 4000, 400D, and 400E may be attached by a mounting bracket 402C, which may be a similar bracket as described above and mounted on a single side of the pontoon 100. In another example, there need not be a bracket at the location of mounting bracket 402C, such as if the "L" shaped support formed by a rotating spindle arm 410 (described in detail below) and the spindle 400C, 400D, 400E, has sufficient strength, sturdiness, or the like, to support the spindle 400C, 400D, 400E, for example, in a cantilevered manner.

In an example, the spindle 400C, 400D, 400E may be attached, connected, coupled, fixed, or the like, to the rotating spindle aim 410, which may be coupled to the rear of the pontoon 100, such as at a lower portion 411 at the rear of the pontoon 100, such as through a recess (e.g., a hole) in the lower portion 411, or a bracket or the like attached to the lower portion 411. The rotating spindle arm 410 may be configured to rotate the spindle 400C, 400D, 400E from the rear of the pontoon 100 (e.g., through a 180 degree rotation), which may allow the spindle 400C, 400D, 400E to be attached or removed when the pontoon 100, is against, for example, a dock. The spindle 400C, 400D, 400E may be removed from the pontoon 100 such as by removing the rotating spindle arm 410 from the lower portion 411 of the rear of the pontoon 100, or by disengaging, removing, or the like, the spindle 400C, 400D, 400E from the rotating spindle arm 410. As such, the spindle 400C, 400D, 400E may be attached to the rotating spindle arm 410 so as to be permanently attached to the rotating spindle arm (e.g., welded, bolted, or the like), or to be removably attached to the rotating spindle arm (e.g., via threads in the connecting portions of the spindle 400C, 400D, 400E and rotating spindle arm 410 that screw, or twist together, via a pin, or other similar locking mechanism).

Figure 4F:
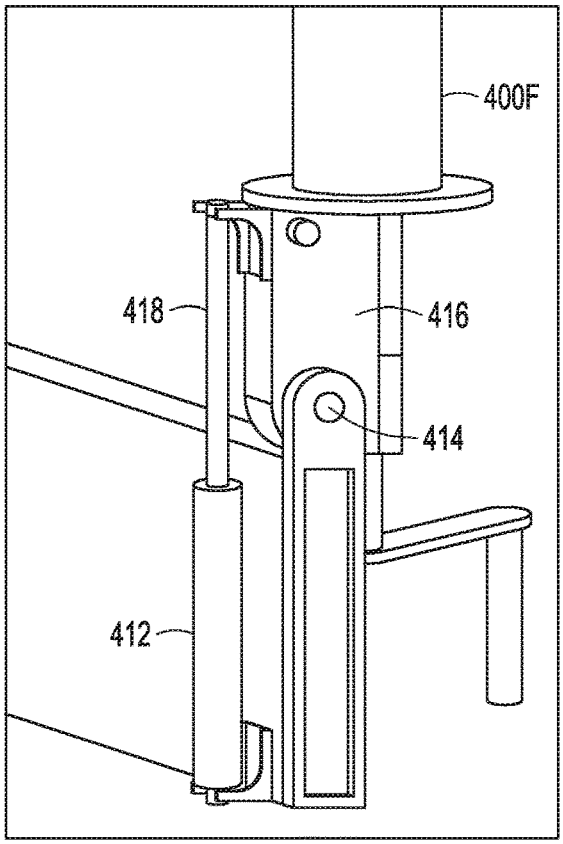

In an example as illustrated in FIG. 4F, the spindle 400F may be coupled, attached, connected, or the like to a spindle actuator 412. The spindle actuator 412 may be a motorized linear actuator, an air piston, or other similar actuation member. The connection of the spindle 400F to the spindle actuator 412, may include one or more connections to an actuator mount 416, and a connection at an actuator mount hinge 414, which may, when an actuator piston 418 is extended from the actuator 412, may cause the spindle 400F to rotate vertically (e.g., at the hinge 414) at approximately a 90 degree angle or other suitable angle. This may cause the spindle 400F to be substantially perpendicular with the deck of the pontoon 100. The spindle 400F may be removable (such as by lifting the spindle 400F out of a bracket as described above) to allow the cover 102 to be stored while the pontoon 100 is in use. In an example, the tension of the cover 102 at each end of the spindle 400A-400F may be adjusted independently, for example, to account for variances in fixtures (e.g., seats, windshields, or other interior fixtures) between opposite sides of the interior of the pontoon 100 and obtain the proper tension across the entire cover as it is deployed over the pontoon. Further, any of the spindle 400A-400F and bracket 401A-401B, and 402A-

402C, may be adapted, adjusted, configured, or the like to incorporate (e.g., not interfere with) the mounting of a motor on the rear/back of the pontoon 100.

Any portions of an embodiment described with respect to FIGS. 3-4F may be suitable used with any other embodiment described with respect to FIGS. 3-4F. For example, and example only, the ratchet wheel 308 and/or pall 312 illustrated in FIG. 3 may be suitably applied to any other embodiment described in FIGS. 4A-4F. Similarly, for example, the embodiment described with respect to FIG. 3 may also be configured as first and second translatable mounting bracket portions, like the inner 401A, 401B and outer 402A, 402B portions described above.

The securing system described below discloses a number of securing members and securing member supports which secure the cover to a pontoon, such as at the sides of the pontoon. The pontoon covering systems described herein, employing the disclosed securing members and securing member supports make it easier and more convenient to deploy and tautly secure the cover to the pontoon. The securing system will also better protect the inner fixtures on the deck of the pontoon from dirt or damage while the pontoon is being stored.

Figure 5:
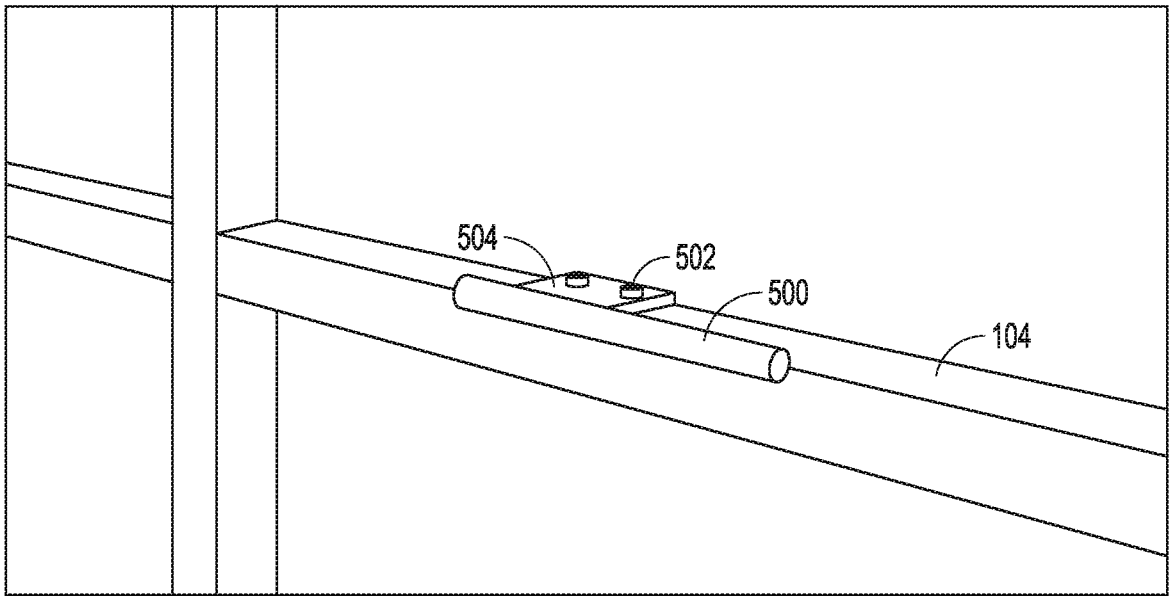
FIG. 5 illustrates an example of a cover securing pin attached to the frame of the pontoon.

FIG. 5 illustrates an example of a securing member in the form of a cover securing pin 500 attached to the frame of the pontoon. In an example, one or more cover securing members may be secured to either of the sides of the pontoon 100, such as on a portion of the pontoon frame rail 104. The cover securing pin 500 may be comprised of a metal (e.g., aluminum, steel, iron, or the like) or another rigid material (e.g., plastic), and mounted/secured to the pontoon frame rail 104, such as by bolts 502, screws, or the like through a pin securing member 504 which may be formed as a bracket or other similar securing member through which the bolts 502 may be passed to secure the pin securing member 504 to the pontoon rail 104. In another example, the pin securing member 504 may be welded or otherwise permanently attached to the pontoon rail 104.

Figure 6:
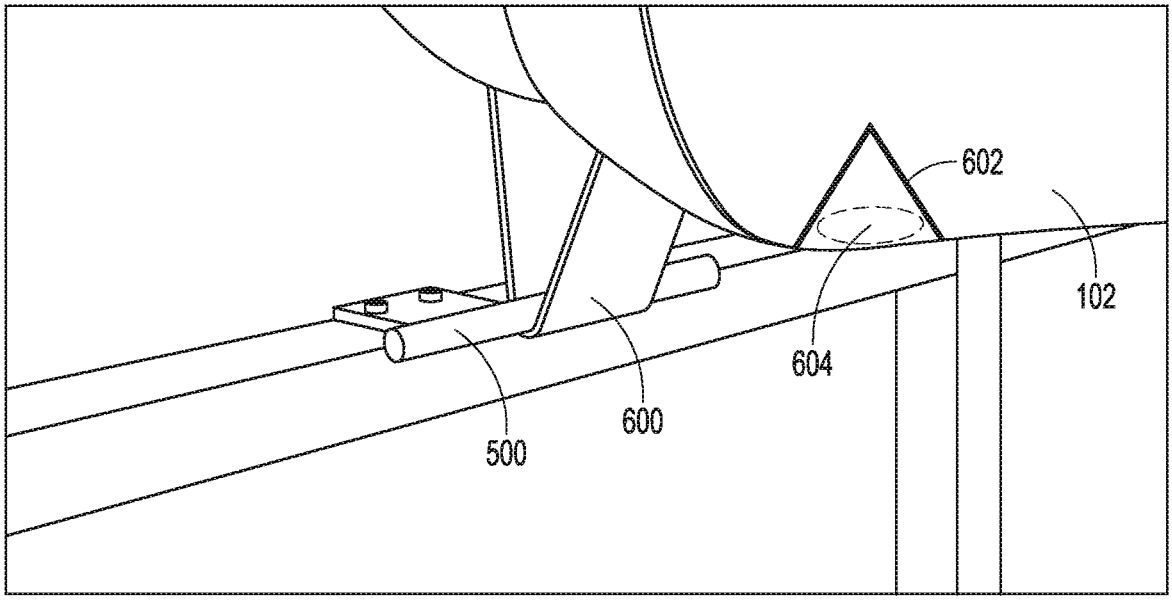
FIG. 6 illustrates an example of a loop securing the cover to the cover securing pin.

FIG. 6 illustrates an example of a securing member support in the form of a loop securing the cover to the cover securing pin. In an example, the cover securing pin 500 may be secured to the cover by being secured within a loop 600 affixed to the cover 102. In an example, the loop 600 may be of a material different from the cover 102, such as an elastic material, a stretchable fabric, or the like. In another example, the loop 600 may be formed from the same material as the cover 102. In an example, the loop 600 may be replaced by a pocket or other catchable structure that may be grabbed or caught by pin 500.

When the cover 102 is deployed, by unspooling the cover 102 from the spindle 400A-400F and placing the cover over the support structure 200, the loop 600 may be located to be near a front portion of the cover securing pin 500, such as in front of, ahead of, or the like, the cover securing pin 500. The location of the loop 600 when the cover 102 is deployed may be aided by use of a weight 604 located within a portion of the cover 102, such as a pocket 602 formed in the cover 102, such as sewn into a lower edge portion of the cover 102. Multiple weights 602 may be located at multiple locations in the cover 102 to aid in placement of the multiple loops such as loop 600. For example, a weight or weights may be positioned generally near or adjacent to one or more of each of the loops 600. In one example, at least one weight 602 may be included generally on each side of loop 600 (e.g., in front of the loop (e.g., toward the bow of the pontoon) and behind the loop(e.g., toward the stern of the pontoon)), which may aid in aligning the loop 600 with or holding the loop 600 in place with respect to a securing member (such as pin 500 or one of the securing members described in FIGS. 7-10 below). The weight(s) 604 may also aid when rolling the cover 102 back up around the spindle 400A-400F, for example when flipping, folding, or the like, the sides of the cover 102 over the center of the cover 102, so the cover 102 fits the width of the spindle 400A-400F, or to keep the folded portions of the cover 102 in place while rolling/spooling/winding the cover 102 around the spindle 400A-400F. The weight(s) 604 may be particularly helpful when deploying, securing, or removing/storing the cover 102 when outside and exposed to the wind. In an example, a weight 604 may be at least one-half ounce, but may be larger (e.g., in a range from 0.5-5 ounces) as desired or required by the particular pontoon or cover material.

When the cover 102 is pulled taut, e.g., by rotating the spindle rotating handle 306, the loop 600 may be caused to be secured to the pin 500 such as by sliding onto the pin 500 as the cover 102 is pulled taut. It is understood that there may be multiple pins such as pin 500 attached to the pontoon 100 as described above at multiple locations, as well as multiple corresponding loops, such as loop 600.

In an example, the cover 102 may be secured on one or each of the sides of the pontoon 102 with the assistance of a plurality of magnets. For example, a plurality of magnets may be sewn, or otherwise attached to the cover 102, such as near, adjacent to, or in front of or behind one or more of the loops 600. This may aid each loop 600 in aligning with a corresponding cover securing pin 500, and attract the cover 102 in the area of the loops to the corresponding cover securing pin 500 as the cover 102 is pulled taut. In such an example, the cover securing pins 500 will be formed from a material (e.g., a metal) which is magnetic, or to which a magnet will be attracted.

Figure 7C:
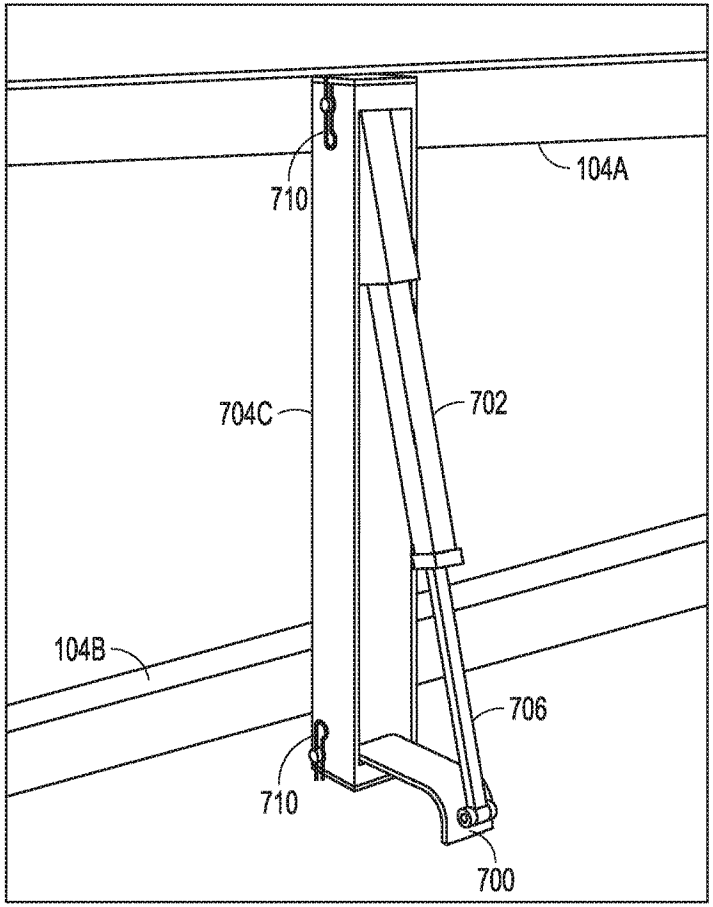
FIGS. 7A-7C illustrate examples of a linear actuator and cover securing hook housing and deployment.
Figure 7B:
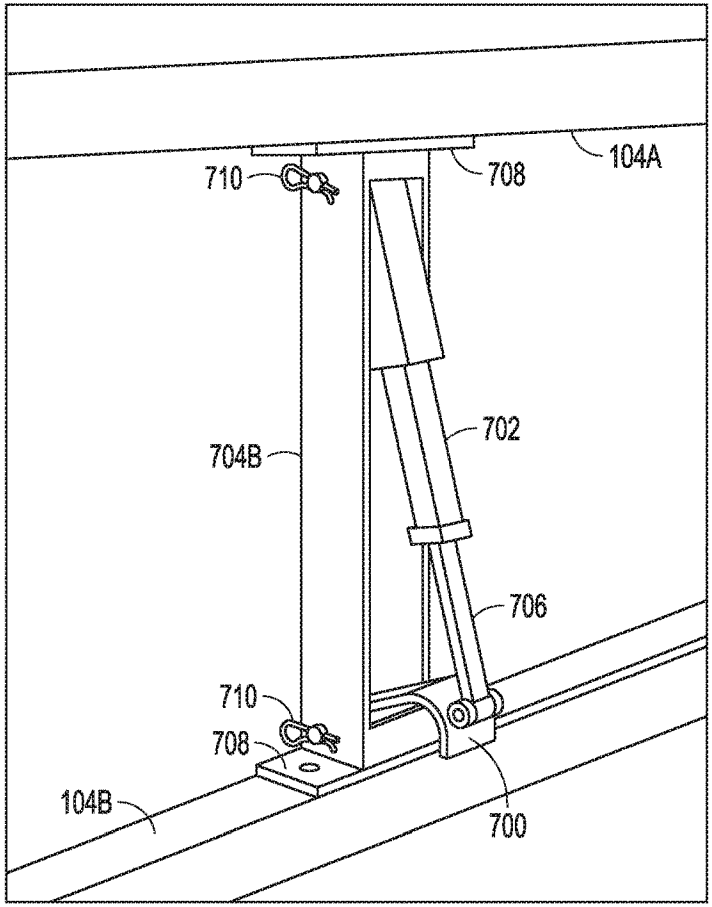
Figure 7A:
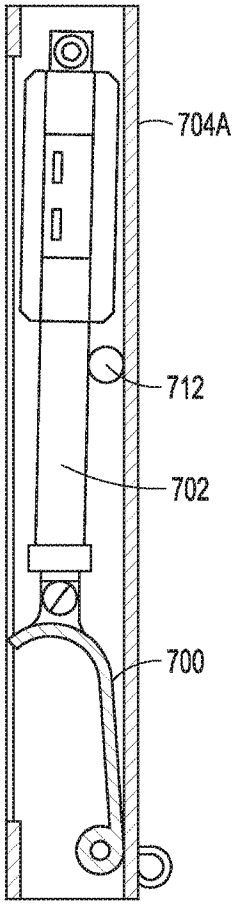

FIGS. 7A-7C illustrate examples of a securing member in the form of a linear actuator and cover securing hook housing and deployment. In the examples of FIGS. 7A-7C, a linear actuator system may be used as a securing member in place of the cover securing pin 500, discussed in FIGS. 5 and 6 above. With reference to FIG. 7A, a cover securing hook 700 may be connected, coupled, fixed, or the like, to a cover securing linear actuator 702, such as by connecting the cover securing hook 700 to a cover securing linear actuator piston 706. The cover securing linear actuator 706 may extend from the linear actuator 702 when the linear actuator 702 is powered (such as through a switch, button, or the like, connected to a battery) to supply power, current, or the like to the cover securing actuator 702. This may cause the cover securing actuator piston 706 to extend from the cover securing linear actuator 702, and secure the cover securing hook 700.

In an example, the cover securing linear actuator 702, and the cover securing hook 700 may be at least partially enclosed in an actuator housing 704A-704C. The actuator housing 704A-704C may be constructed of a material such as aluminum, or another similar material with a similar strength, corrosion resistance and weldability as aluminum, or other suitable material such as plastic. Similarly, the cover securing hook may be constructed from aluminum or another similar material, or other suitable material such as plastic.

The linear actuator 702 and the cover securing hook 700 may be connected to the actuator housing 704A-704C via a pin or other similar securing member such as cotter pins 710 shown in FIGS. 7B and 7C. The connection may cause a pivot point around which the linear actuator 702 and the cover securing hook 700 may rotate, pivot, turn, or the like, as they move from their stored positions shown in FIG. 7A, mid deployment position in FIG. 7B, and fully deployed position in FIG. 7C.

In a non-limiting example as shown in FIG. 7B, the actuator housing 704B may be mounted (e.g., by a bolt, screw, pin, or the like) inside, between, or the like, two vertically displaced pontoon rails 104A, 104B. This may be accomplished by attaching (e.g., welding) a flanged endpiece 708 to the top and bottom of linear actuator housing 704B, the flanged endpiece 708 including mounting holes that allow the housing 704B to be secured to each of the pontoon frame rails 104A and 104B.

In another non-limiting example shown in FIG. 7C, the actuator housing 704C may be mounted, secured, or the like on an outer portion of at least one pontoon rail 104, and in at least one example to at least two vertically displaced frame rails 104A and 104B. It is understood that the cover securing linear actuator 702 may be mounted, secured, fixed, or the like to the pontoon 100, such as on one or more portions of the pontoon frame or rails 104 in other arrangements than described above, or with or without some variation of an actuator housing 704A-704C. Different actuator sizes and specifications (e.g., the amount of force an actuator can resist when powered off to keep the cover 102 in place in windy weather conditions) may be used in the system.

In an example, the cover securing hook 700 may secure into a loop such as 600 described above, or pocket formed into the cover 102, (e.g., a pocket sewn into the cover 102) which the cover securing hook 700 can extend into, or grab onto, as the linear actuator piston 706 extends, causing the cover securing hook to be located in a final or fully extended position (as shown in FIG. 7C). The final or fully extended position may include when the cover securing hook is substantially flat, or generally perpendicular to the linear actuator housing 704A-700C. It is understood however, that the final or fully extended position of the cover securing hook may extend to a position other than flat (e.g., to any suitable angle relative the actuator housing), to be secured within the loop 600 or pocket.

The size of the actuator 702, the length of the actuator piston 706, and the sizes/dimensions of the cover securing hook 700 and the actuator housing 704A-704C may vary or be adjusted depending on the dimensions of the pontoon 100 and the pontoon frame rails 104. Similarly, the number of actuators used/attached to the pontoon 100 may vary depending on the dimensions of the pontoon 100 and the frame rails 104. For example, a plurality of actuators may be employed along the sides of the pontoon, such as between 1-4 actuators (or more) on each side, depending on the size/length of the pontoon.

In an example, when the cover securing linear actuator 702 and the cover securing hook 700 are retracted into the actuator housing 704A-700C by retracting the linear actuator piston 706 into the linear actuator 704, the actuator 704 and the cover securing hook 700 may sit in the actuator housing 704A-704C without fully retracting into the actuator housing 704A-704C, such that the actuator 702 does not sit in a way that its longitudinal axis is completely or substantially parallel with a longitudinal axis of the actuator housing 704A-704C. By allowing the actuator 702 and hook 700 assembly to be positioned (e.g., to sit) within the actuator housing 704A-704C at an angle other than exactly straight up and down, it may prevent the actuator 702, the actuator piston 706 and the hook 700 from being stuck or locked inside the actuator housing 704A-704C, precluding deployment of the actuator piston 706 to extend the cover securing hook 700. This may be accomplished through the use of one or more stoppers 712 (which may be a pin, a rod, a plug, or the like) that may be located between at least one of the actuator 702, or the cover securing hook 700 and an interior wall, e.g., a back portion, of the actuator housing 704A-704C. As the linear actuator piston 706 is retracted into the cover securing linear actuator 702, the stopper 712 may prevent the cover securing linear actuator 702 or the cover securing hook 700 from reaching, achieving, or the like, an exactly parallel position with respect to the longitudinal axis of the actuator housing 704A-704C. In another example, the cover securing linear actuator 702 may be connected to a controller, which may be configured or programmed (such as through instructions executed by a processor connected to the controller) to prevent the actuator 702 from reaching, achieving, or the like, an exactly parallel position with respect to the longitudinal axis of the actuator housing 704A-704C.

Figure 8:
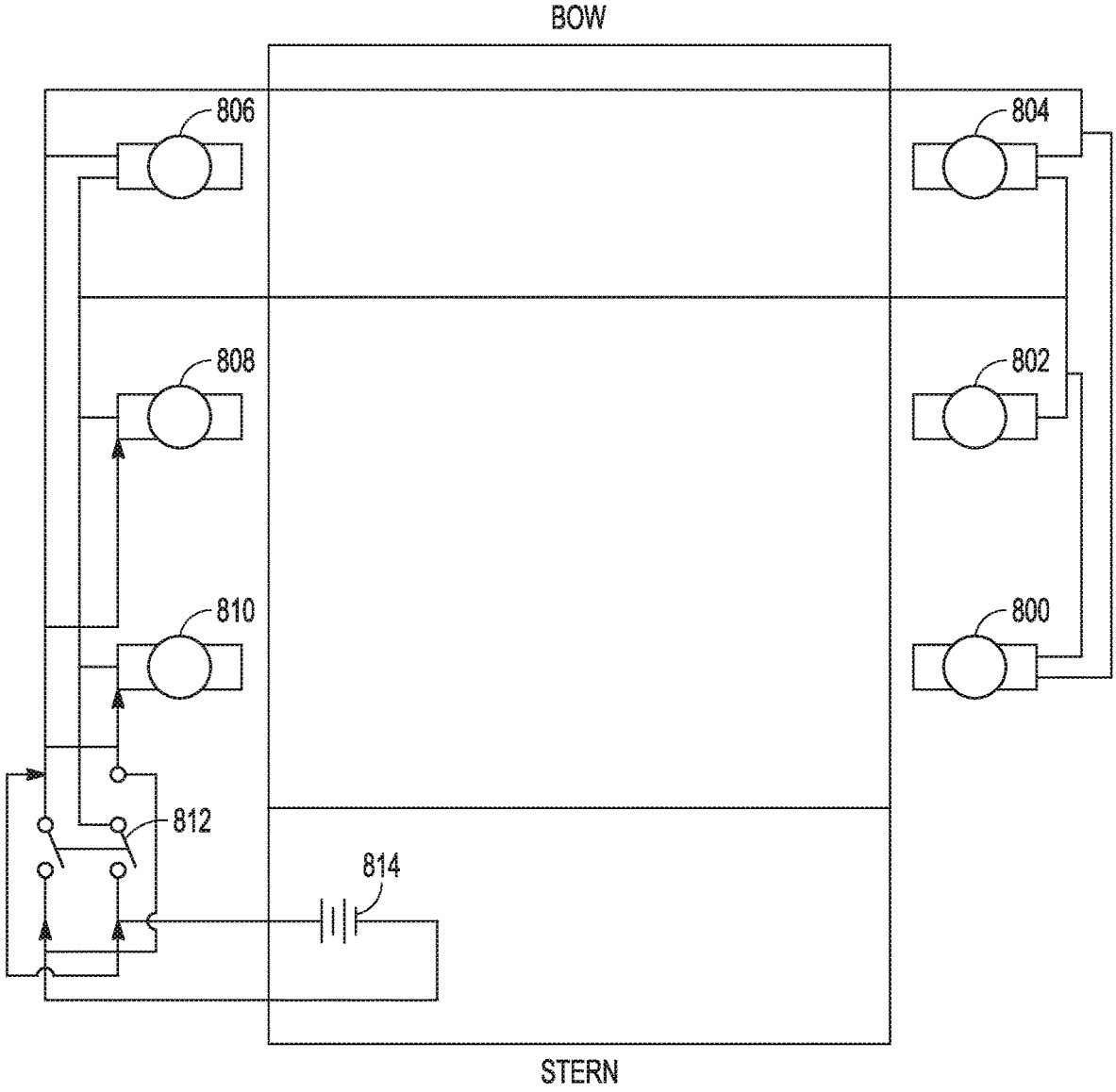
FIG. 8 illustrates an example of a wiring diagram to wire multiple linear actuators to a switch and battery allowing for automatic deployment of the linear actuators.

FIG. 8 illustrates an example of a wiring diagram to wire multiple linear actuators, such as actuators 702, to a switch and battery allowing for automatic deployment of the linear actuator. In an example, a plurality of actuators 800, 802, 804, 806, and 810, may be located along the sides of the pontoon 100. The actuators 800-810 may be connected, via one or more wires, to a switch, 812 (e.g., a six-pin double throw switch) and a battery 814 (e.g., a 12 volt battery). The battery 814 may be an existing battery factory installed on the pontoon 100, or separately added. The switch 812 may be located near the battery 814, such as near the stern/rear/back of the pontoon 100. The switch 812 may connect to a button, or other actuation member to allow a user to simultaneously extend or retract all the plurality of linear actuators 800-810.

The plurality of linear actuators 800-810 may be wired to the switch 812 and the battery 814 using, for example, one or more wires running along the underside of the pontoon 100, above the floorboard of the pontoon 100 (e.g., under any carpeting and/or behind fixtures of the pontoon 100), through a portion of the pontoon frame rail 104, a housing attached to the pontoon frame rail 104, or some combination thereof. In the event of a mechanical or electrical failure (e.g., the wired actuators 800-810 failing to retract, release, or the like from the loop/pocket 600), the cover 102 may be manually loosened (e.g., the tension in the cover manually released by releasing tension in the spindle 400A-400F) and removed from the securing members, such as the cover securing pin 500, the cover securing linear actuator 702, the plurality of linear actuators 800-810, or any of the securing members described herein.

Figure 9A:
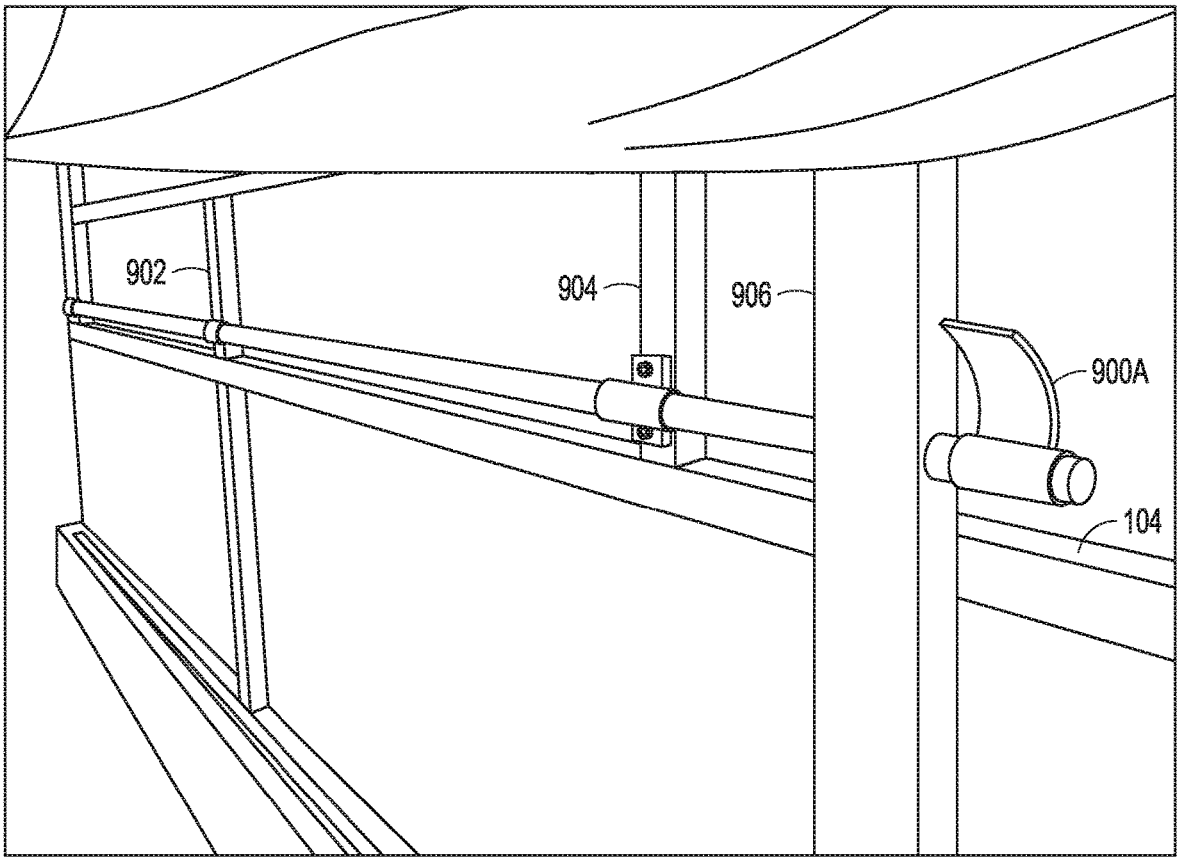
FIGS. 9A-9C illustrate an example of an alternate cover securing member with an alternate cover securing hook attached to a cover securing rod.
Figure 9B:
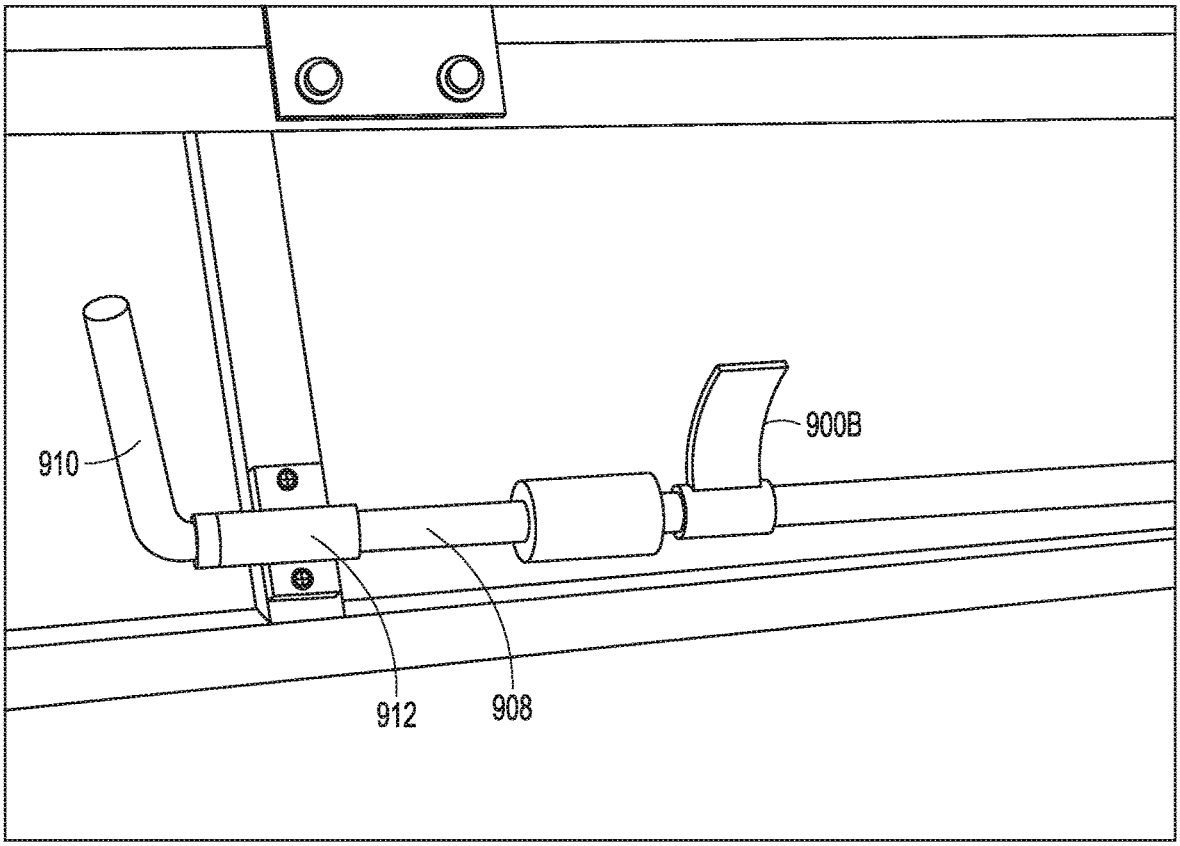
Figure 9C:
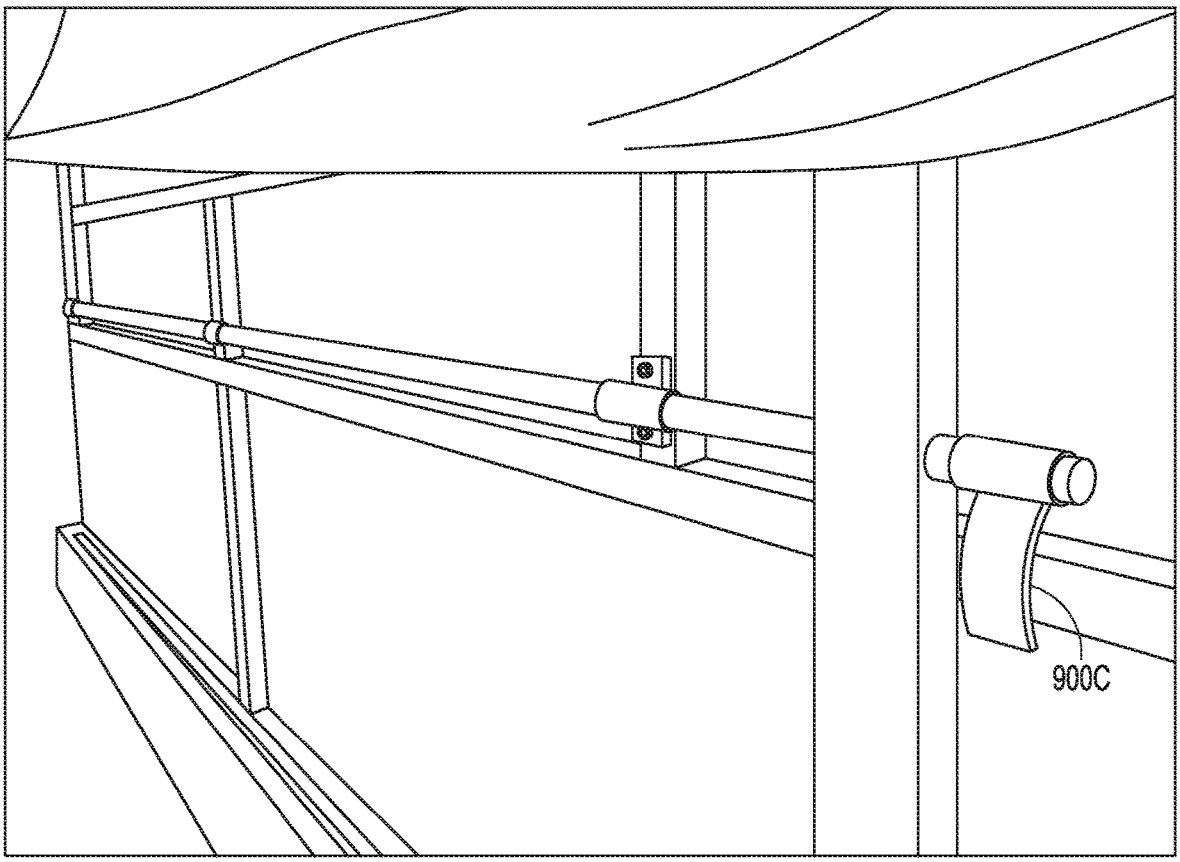

FIGS. 9A-9C illustrate an example of another cover securing member with a cover securing hook attached to a cover securing rod. In the non-limiting examples shown in FIGS. 9A-9C, a cover securing hook 900A, 900B, 900C, formed from a material such as aluminum, steel, plastic, or the like, may be connected (e.g., welded, bolted, glued, etc.) to a cover securing rod 908 which may be formed from the same or a similar material as the cover securing hook 900A-900C. The cover securing rod 908 may be attached to the pontoon 100, such as via one or more cover securing rod brackets 912 which may be connected to one or more cover securing rod supports 902, 904, 906 attached to the pontoon 100 or pontoon frame rail 104, to one or more portions of the pontoon frame rail 104, or a combination thereof.

A cover securing rod bracket 912 may be configured to act as a sheath or lumen around the cover securing rod 908 that allows the cover securing rod 908 to move (e.g., to slide, rotate, translate, or the like), to move or secure the cover securing hook 900A-900C into a position to align with and engage with the loops/pockets 600 and secure the cover 102. The cover securing rod 908 may be configured and located so as to run, span, traverse, or the like, along a side of the pontoon 100, for example, substantially along the length of each side of the pontoon 100, or the entire length of each side of the pontoon 100, and may include one or more cover securing hooks 900A-900C, each designed to align with and engage a corresponding loop/pocket 600 of the cover 102.

As shown in FIG. 9B, a cover securing rod handle 910, may be attached (e.g., welded, bolted, glued, or the like) to the cover securing rod 908. In an example, the cover securing rod 908 and the cover securing rod handle 910 may be formed from a single piece of material (e.g., aluminum, steel, or another similar metal, or another rigid material such as plastic). When the cover securing handle 910 is in a first or "up" position, as shown in FIG. 9B, the cover securing hook 900B may be in an "up" or disengaged position. When the cover securing handle is rotated to a second or "down" position, the cover securing hook 900A-900C may move from the disengaged position as shown in FIGS. 9A and 9B, to a "down" or engaged position as shown in FIG. 9C. In the engaged position, the cover securing hook 900A-900C may catch, secure to, or the like, a loop or pocket such as loop 600 or a pocket attached or sewn into the cover 102, as described above, thereby tautly securing the cover 102 to the pontoon 100. In an example, the cover securing hook 900A-900C may be translatable, adjustable, or otherwise repositionable along the cover securing rod 908 to aid in positioning the cover securing hook 900A-900C with respect to a corresponding loop/pocket 600. In such an example, the cover securing hook 900A-900C may be temporarily or semi-permanently set in position using a set screw, a pin, or the like.

Figure 10:
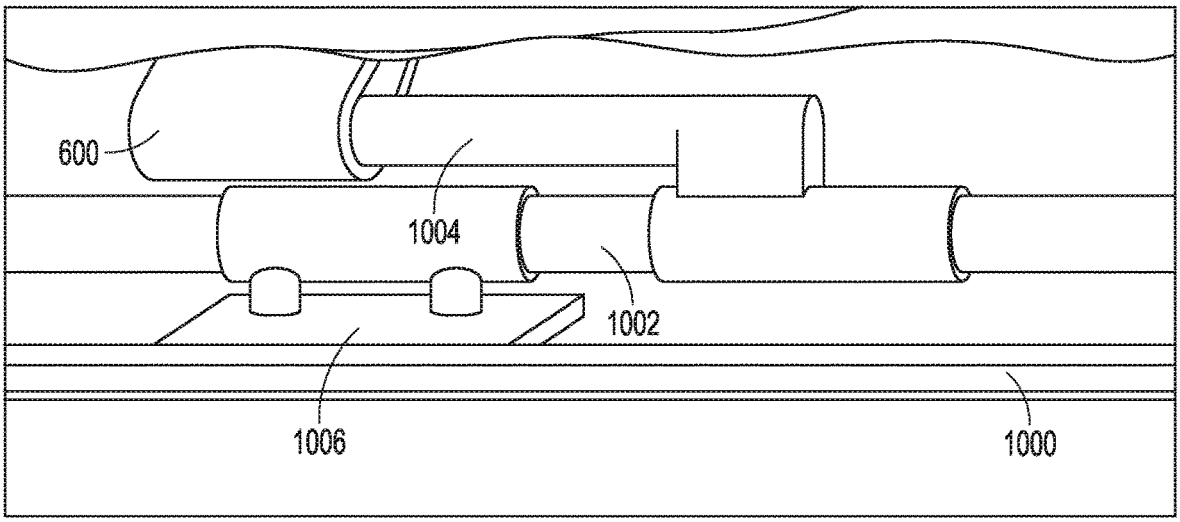
FIG. 10 illustrates an alternate example of a cover securing member with an alternate design for a cover securing pin connected to a cover securing rod movable along a track.

FIG. 10 illustrates another example of a cover securing member with a cover securing pin connected to a cover securing rod movable along a track. In an example, an optional cover securing rail 1000 may be fixed, attached, coupled, or the like, to the pontoon 100, such as to the frame rail 104. The cover securing rail 1000 may be attached so as to span, run, or traverse one or both sides of the pontoon, along a portion of the side, or in an alternate example, along an entire length of one or both sides of the pontoon 100, and may aid in the installation of a cover securing rod sheath 1006, or particularly, multiple sheathes 1006. A cover securing rod 1002, may traverse through the cover securing rod sheath(es) 1006, which may be similar to the cover securing rod bracket 912 as described above, is configured to act as a sheath or lumen through which an alternate cover securing rod 1002 may slide, translate, rotate, or otherwise move. In an example, the cover securing rail 1000 may be eliminated, and the cover securing rod sheath may be alternately mounted, secured, or the like to the pontoon 100, such as directly to the side of the pontoon 100, or the frame rail 104.

A cover securing rod pin 1004 may be fixed or connected to the cover securing rod 1002, such as by being welded, bolted, glued, or the like, to the cover securing rod 1002. Similar to the examples of FIGS. 9A-9C above, the cover securing rod 1002, and the cover securing pin 1004, may be formed from a rigid material, such as a plastic or a metal like aluminum, steel, or the like. Likewise, the cover securing rail 1000 may be formed from the same or another similar material as the cover securing rod 1002 and cover securing pin 1004.

The cover securing pin 1004 may be configured to secure into the loop 600 as described above, or a similar pocket sewn into the cover 102, to secure the cover 102 to the side of the pontoon 100 as the cover 102 is deployed and secured by tightening as described above. The cover securing rod sheath 1006 may be fixed, static, or otherwise immobile at a location along the pontoon 100, and the cover securing rod 1002 may be movable so as to slide, rotate, translate or the like in a left-to-right, or right-to-left, or otherwise substantially horizontal manner, to secure the alternate cover securing pin 1004 within the loop 600. The cover securing rod 1002 may also have a handle such as 910 in FIG. 9B, for manual actuation. Alternately, the cover securing rod 1002 may be electronically controlled for automatic actuation. As described above in relation to the cover securing hook 900A-900C, the cover securing pin 1004 may be translatable, adjustable, repositionable, or the like, along the cover securing rod 1002, and may be temporarily or semi-permanently set in position on the cover securing rod 1002 using a set screw, a set pin, or the like.

In addition to the attachments described above to secure the cover 100 to the sides of the pontoon as described above, the cover may be secured to the front/bow of the pontoon 100, through fastening members located, affixed, attached, or the like (e.g., sewn into) on the front edge of the cover (e.g., snaps, magnets, hooks and eyes, or the like), and on to a front edge (such as a rail extending across the front) of the pontoon. Such a securing of the cover 102 in the front of the pontoon 100, may allow the side fastening members as described above to align with the loop 600 or pockets sewn into the cover 102 as the cover 102 is pulled taut by rotating the spindle rotating handle 306.

While described herein primarily with respect to a pontoon, the various embodiments of the present disclosure may similarly be configured for and used with any other type of boat.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is to allow the reader to quickly ascertain the nature of the technical disclosure and is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the embodiments should be determined with reference to the appended claims, along with the full scope of equivalents to which such claims are entitled.

What is claimed is:

1. A pontoon cover securing system comprising a cover securing member configured to be connected to a side portion of a pontoon, the cover securing member comprising:

a cover securing rod configured to be movable relative a rail of the pontoon; and a cover securing pin connected to the cover securing rod and configured to be movable with the cover securing rod relative the rail of the pontoon; the cover securing pin configured to engage a cover securing member support of a pontoon cover.

2. The pontoon cover securing system of claim 1, wherein the cover securing member further comprises a cover securing rail configured to be attached to the side portion of the pontoon, and wherein the cover securing rod is configured to be movable relative the cover securing rail.

3. The pontoon cover securing system of claim 2, wherein the cover securing member further comprises a bracket operably connecting the cover securing rod to the cover securing rail.

4. The pontoon cover securing system of claim 1, wherein the cover securing member is configured to be connected to a frame rail of the pontoon.

5. The pontoon cover securing system of claim 1, further comprising the pontoon cover having the cover securing member support.

6. The pontoon cover securing system of claim 1, wherein the cover securing member is configured to be connected to a first side portion of the pontoon, and further comprising a second cover securing member configured to be connected to a second side portion of the pontoon, the second cover securing member comprising:

a second cover securing rod configured to be movable relative a second rail of the pontoon; and a second cover securing pin connected to the second cover securing rod and configured to be movable with the second cover securing rod relative the second rail of the pontoon, the second cover securing pin configured to engage a second cover securing member support of the pontoon cover.

7. The pontoon cover securing system of claim 1, wherein the cover securing pin is repositionable along the cover securing rod.

8. The pontoon cover securing system of claim 7, wherein the cover securing pin is configured to be set in position along the cover securing rod using at least one of a set screw or set pin.

9. The pontoon cover securing system of claim 1, wherein the cover securing rod is movable by electronic actuation.

10. The pontoon cover securing system of claim 1, further comprising a spindle configured to support the pontoon cover and configured to be operably connected to a rear portion of the pontoon.

11. The pontoon cover securing system of claim 10, further comprising a spindle mounting bracket configured to be connected to a rear portion of the pontoon, wherein the spindle is removably connectable to the spindle mounting bracket.

12. A cover securing member configured to be installed along a side portion of a pontoon, the cover securing member comprising:

a cover securing rod movable along a track relative a rail of the pontoon; and a cover securing pin connected to the cover securing rod and configured to be movable with the cover securing rod relative the rail of the pontoon, the cover securing pin configured to engage a cover securing member support of a pontoon cover.

13. The cover securing member of claim 12, further comprising a sheath through which cover securing rod is movable.

14. The cover securing member of claim 12, configured to be installed to a frame rail of the pontoon.

15. The cover securing member of claim 12, wherein the cover securing pin is repositionable along the cover securing rod.

16. The cover securing member of claim 15, wherein the cover securing pin is configured to be set in position along the cover securing rod using at least one of a set screw or set pin.

17. The cover securing member of claim 12, wherein the cover securing rod is movable along the track by electronic actuation.

18. The cover securing member of claim 12, further comprising a handle connected to the cover securing rod enabling manual actuation of the cover securing rod.

* * * * *